United States Patent [19]

Streich et al.

[11] 4,453,057

[45] Jun. 5, 1984

[54] CONTACT ARRANGEMENT FOR ELECTRIC SWITCHGEAR

[75] Inventors: Georg Streich, Amberg; Werner Harbauer, Schwandorf; Johann Bauer, Ebermannsdorf, all of Fed. Rep. of Germany

[73] Assignee: Siemens Aktiengesellschaft, Berlin and Munich, Fed. Rep. of Germany

[21] Appl. No.: 408,884

[22] Filed: Aug. 17, 1982

[30] Foreign Application Priority Data

Sep. 14, 1981 [DE] Fed. Rep. of Germany ..... 3136354

[51] Int. Cl.[3] ..... H01H 1/20

[52] U.S. Cl. ..... 200/243; 200/280

[58] Field of Search ..... 200/243, 275, 280

[56] References Cited

U.S. PATENT DOCUMENTS

| | | | |
|---|---|---|---|
| 3,200,225 | 8/1965 | Lemke | 200/243 |
| 3,272,949 | 9/1966 | Lawrence | 200/166 |
| 3,324,270 | 6/1967 | Lacan | 200/243 |
| 4,006,322 | 2/1977 | Gallatin et al. | 200/243 X |
| 4,121,073 | 10/1978 | Bileski et al. | 200/243 X |

FOREIGN PATENT DOCUMENTS

| | | | |
|---|---|---|---|
| 1744061 | 9/1956 | Fed. Rep. of Germany . | |
| 1140264 | 11/1962 | Fed. Rep. of Germany . | |
| 9550 | of 1907 | United Kingdom | 200/280 |

*Primary Examiner*—John W. Shepperd
*Assistant Examiner*—Renee S. Kidorf
*Attorney, Agent, or Firm*—Kenyon & Kenyon

[57] ABSTRACT

A contact arrangement for electric switchgear is disclosed. The contact arrangement comprises a bifurcated offset contact bridge having two contact bridge parts, each of which is inserted into an opening in an actuating contact bridge carrier. Each contact bridge part rests on a first supporting surface of the opening. A spring retainer rests against the contact bridge and a compression spring is mounted between a second surface of the opening and the spring retainer. The spring retainer is guided in the contact bridge carrier against movement transverse to the direction of motion of the carrier. Each end of each contact bridge part is provided with a semicircular contact pad which, when the contact bridge parts are placed adjacent each other, form a bifurcated circular contact pad which engages with corresponding stationary contacts. Each part of the bifurcated contact bridge is provided with a recess on both sides in the area of the offset in order to maintain both contact bridge parts in close proximity with each other and to ensure proper contact engagement.

5 Claims, 3 Drawing Figures

CONTACT ARRANGEMENT FOR ELECTRIC SWITCHGEAR

BACKGROUND OF THE INVENTION

The present invention relates to a contact arrangement for electric switchgear, and more particularly electromagnetic switchgear of the type having an offset contact bridge held in a contact bridge carrier by a spring retainer which is guided against displacement transverse to the direction of motion of the contact bridge. In contact arrangements of this type, the spring retainer is held against the offset contact bridge by the force of a contact compression spring displaceable in the direction of motion of the contact bridge. The contact bridge is moved by the contact bridge carrier so that contact pads of the contact bridge are brought into contact with the corresponding contact pads of adjacent stationary contacts.

In known switchgear of the above-mentioned type, an offset contact bridge is inserted into an opening of a contact bridge carrier and is held against displacement transverse to the direction of motion of the contact bridge carrier by a compression spring and spring retainer. See, e.g., German Gebrauschsmuster No. 1744061 and German Auslegeschrift No. 1140264. It is an object of the present invention to modify this known contact arrangement in such a way that it can be utilized to switch electronic circuitry with a minimum of switching noise. An additional object of the invention is to facilitate automatic assembly of contact arrangements of this type.

SUMMARY OF THE INVENTION

These and other objects of the present invention are conveniently achieved by the provision that the offset contact bridge is divided into two contact bridge parts in the longitudinal direction and by providing each part with a recess on both sides in the region of the offset. It is thereby possible, in contrast to the known arrangement of U.S. Pat. No. 3,272,949, in which the individual contact bridges are disposed at a small distance from each other, to hold the contact bridges so close to each other that the individual contact pads rest practically as a closed whole on the one-part stationary contact pad, thus completely utilizing the cross section of the contact pad of the stationary contact. In order to insert the closely adjacent contact bridge parts, preferably automatically, into an opening in the contact bridge carrier between the spring retainer and an edge of the opening in a simple manner, it is advantageous if the contact bridge parts are provided with extensions near the contact pads for introducing the contact bridge parts between the spring retainer and the edge of the opening in the contact bridge carrier. Interference with the contact pad upon insertion can be prevented with certainty if the contact pads are designed with slanting edges in the direction of insertion of the contact bridge. The circular cross section of the contact pads of the stationary contacts can be retained if the contact pads of each contact bridge part are semicircular in design.

These and other novel features and advantages of the invention will be described in greater detail in the following detailed description.

DETAILED DESCRIPTION

Figure 2:
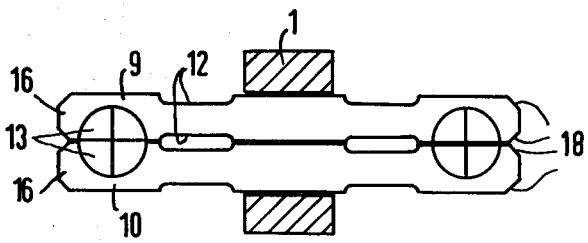
FIG. 2 is a top view of the contact arrangement of FIG. 1 with the contact bridge carrier shown in cross section.
Figure 1:
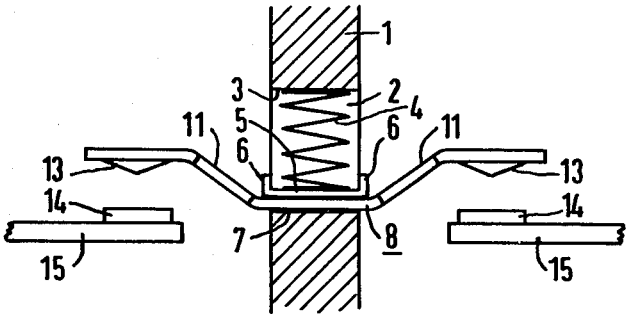
FIG. 1 is a side view of the contact arrangement according to the invention.
Figure 3:
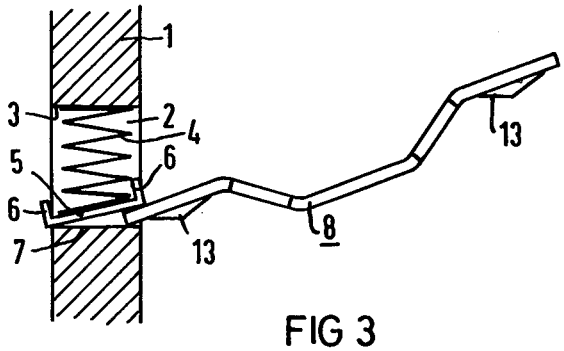
FIG. 3 is a side view illustrating how the contact bridge parts may be easily inserted into the contact bridge carrier opening.

With reference to the drawings, contact bridge carrier 1 which is driven by a magnetic actuator, not shown, has a window-like opening 2 having a support edge 3 which engages the contact compression spring 4, the other end of which rests against the spring retainer 5. The spring retainer 5 is movably guided by tabs 6 in the direction of the contact bridge carrier 1, to prevent loss of engagement with spring 4. The contact bridge 8 is of offset design and is secured by the tension of spring 4 between the spring retainer 5 and the support edge 7 of opening 2. The contact bridge 8 is of bifurcated design and comprises two contact bridge parts 9 and 10 which are formed by the lengthwise division of the contact bridge. As shown in FIG. 3 during the initial stage of insertion, both contact bridge parts are inserted between the spring retainer 5 and the support edge 7 instead of a conventional one-piece contact bridge. In the vicinity of the offsets 11, the contact bridge parts 9 and 10 are provided with recesses 12 so that the contact bridge parts have a narrowed width in these areas. The recesses 12 allow the contact bridge parts 9 and 10 to be maintained in close proximity to each other even at the bends of the offsets 11, without binding due to bending or manufacturing intolerances. As also shown in FIG. 2, the contact pads 13 are semicircular so that, after both contact bridge parts 9 and 10 are introduced into the opening 2, a circular bifurcated contact pad is obtained as the total pad, the parts of which lie so closely together that the contact pads 14 of the stationary contacts 15 are practically completely covered without leaving a gap between the two contact pads 13. The arrangement of the contacts and recesses and the bifurcated design insures that clean contact engagement is obtained with a minimum of switching noise, so that the contact arrangement is suitable for switching electronic circuitry.

At the ends of the contact bridge parts 9 and 10, adjacent the contact pads, insertion extensions 16, as shown in FIG. 2, are provided which, as shown in FIG. 3, can be pushed between the spring retainer 5 and the support edge 7 for introducing the contact bridge parts into the opening. The angled design of the contact pads 13 further facilitates sliding of the contact bridge part between the spring retainer 5 and the support edge 7 without interference with the support edge 7 during insertion. The insertion extensions 16 may be provided with bevels 18 so that introduction of the contact bridge parts is further simplified.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a contact arrangement for electric switchgear of the type including:

a contact bridge having a contact pad at each end thereof, said ends being offset from the center portion of said contact bridge;

a movable contact bridge carrier having an opening into which the contact bridge is movably mounted, said contact bridge resting on a first support surface of said opening;

a compression spring mounted in the opening between a second support surface of the opening and the contact bridge;

a spring retainer guided against motion transverse to the direction of the carrier and mounted between said spring and said contact bridge; and stationary contacts which engage the contact pads of the contact bridge when said carrier is moved in a specific direction;

the improvement comprising:

the contact bridge being longitudinally divided into two adjacent contact bridge parts, said contact pad thereby being divided into two parts, each contact bridge part having a narrowed width in the vicinity of the offset, said contact bridge parts being disposed in substantially touching side by side engagement adjacent said ends so that said two parts of said contact pad are also in substantially touching side by side engagement.

2. The improvement recited in claim 1 wherein the contact bridge parts are provided with extensions adjacent said contact pads for inserting said contact bridge parts between said spring retainer and said first support surface.

3. The improvement recited in claim 2 wherein each of said contact pads have a sloping surface, said surface having maximum depth along a center line of said contact pad transverse to the longitudinal direction of each of said contact bridge parts and having decreasing depth moving away from said center line.

4. The improvement recited in claim 1, 2 or 3 wherein each of said contact pads are semicircular in cross section so that when said contact bridge parts are placed adjacent each other, a bifurcated contact pad of circular cross section is formed.

5. The improvement recited in claim 3 wherein said sloping surface comprises a straight, slanted surface.

* * * * *